United States Patent [19]

Kutz et al.

[11] Patent Number: 4,459,838

[45] Date of Patent: Jul. 17, 1984

[54] GRIPPING HEAD OF A SHEET STRETCHER WITH A CENTERING DEVICE

[75] Inventors: Heinrich Kutz, Neuss; Gerd Jung, Koblenz, both of Fed. Rep. of Germany

[73] Assignee: SMS Schloemann-Siemag Aktiengesellschaft, Dusseldorf, Fed. Rep. of Germany

[21] Appl. No.: 359,357

[22] Filed: Mar. 18, 1982

[30] Foreign Application Priority Data

Mar. 21, 1981 [DE] Fed. Rep. of Germany ..... 3111146

[51] Int. Cl.[3] ..... B21D 11/02

[52] U.S. Cl. ..... 72/302; 72/311; 72/34; 33/169 B; 33/172 D; 33/191

[58] Field of Search ..... 72/302, 295, 290, 301, 72/311, 420, 419, 33, 34; 269/225, 34, 307; 254/29 A; 33/191, 189, 169 B, 172 D, 169 C

[56] References Cited

U.S. PATENT DOCUMENTS

| | | | |
|---|---|---|---|
| 961,133 | 6/1910 | Higgins | 72/420 |
| 1,461,425 | 7/1923 | Linebaugh | 269/307 |
| 2,497,733 | 2/1950 | Kebour | 33/189 |
| 3,036,481 | 5/1962 | Dirth et al. | 72/34 |
| 3,082,809 | 3/1963 | Petsch et al. | 72/33 |
| 3,137,947 | 6/1964 | Flower | 33/191 |
| 3,583,823 | 6/1971 | Eaton et al. | 33/191 |
| 3,798,779 | 3/1974 | Gluck | 33/169 C |
| 4,249,405 | 2/1981 | Cyr | 72/34 |
| 4,349,959 | 9/1982 | Urban | 269/34 |

*Primary Examiner*—Daniel C. Crane
*Attorney, Agent, or Firm*—Holman & Stern

[57] ABSTRACT

A gripping head (2) of a sheet stretcher has a centering device (4) for centering a sheet (1) to be stretched in the middle of the gripping head (2) before the sheet is gripped and stretched. The centering device comprises two centering arms (5) which move with their edges towards the longitudinal sides of the sheet and are synchronously displaced in opposite directions and at right angles to the axis of stretching. In order to facilitate optimum gripping of the sheet automatically, guide rods (9) having engaging members (10) sliding thereon are provided on the centering arms (5) and extend parallel to the axis of stretching. The ends of the engaging members (10) have stops (14), against which the front end of the sheet (1) bears when fully inserted. A distance-measuring device (18), is provided on the centering arm (5) and has a cable drum (22) and a potentiometer (20) on the same shaft (21). The end of the cable is secured to the engaging member (10). In this way the depth of insertion may be measured and controlled by the potentiometer (20).

8 Claims, 10 Drawing Figures

GRIPPING HEAD OF A SHEET STRETCHER WITH A CENTERING DEVICE

BACKGROUND OF THE INVENTION

1. Field of the Invention

The invention relates to a gripping head of a sheet stretcher with a centering device, comprising two centering arms which are synchronously displaceable horizontally in opposite directions and at a right angle to the stretching direction for the purpose of centering a sheet to be stretched on to the central axis of the sheet stretcher.

The ends of the sheets to be stretched are gripped in the gripping jaws of the gripping head aperture of the griping head in the sheet stretcher, thus damaging the gripped areas which must be separated as waste. The minimum gripping length, depending upon the sheet thickness in question and corresponding to a given depth of insertion into the gripping head aperture, must be observed—on the one hand—so that the sheet is not pulled out during stretching. On the other hand the minimum gripping length must not be exceeded to too great an extent, in order that the waste may be kept low.

2. Description of the Prior Art

It is still customary today to grip the sheets according to the observations of an assistant who gives hand signals to the operator. This is very imprecise since the view of the ends of the sheets inserted into the gripping jaws is restricted. The possibility of observation is improved by markings applied to the sheet beforehand. The gripping process is thus time-consuming and requires a second operator.

In many cases stops for the sheets are secured in the aperture of the gripping head. If the sheet thicknesses vary, however, they must be changed each time and may only be used starting from a given sheet thickness. There is a very high risk of breakdown on account of the inserted stops for the sheets and changing the stops is awkward and time-consuming.

BRIEF SUMMARY OF THE INVENTION

The object of the invention is thus to provide a device which ensures a predetermined depth of insertion of the sheet into the aperture of the gripping head with substantially greater precision while keeping time and labor to a minimum.

According to the invention this is attained in the gripping head of a sheet stretcher described above in that one or two measuring and switching devices for determining the depth of insertion of the sheet to be stretched are associated with the centering device in the gripping head. In this way it is possible, without the aid of a second operator and only with the aid of the centering devices conventionally attached to the gripping heads, to determine the optimum depth of insertion by measurement, and, when the depth of insertion has been attained, to stop the insertion of the sheet into the gripping head by means of a switching process and to grip the sheet at the optimum length required between the gripping jaws.

In a further development of the invention one or both centering arms of the centering device comprise an engaging member, which is displaceable in the stretching direction, has a stop for the front face of the sheet to be stretched, is displaceably mounted on a guide rod secured to the centering arm and is connected to a measuring apparatus via transmission elements. The centering arms of the centering device are used in known manner to move the sheet to be stretched into the central longitudinal axis of the sheet stretcher before gripping in the gripping heads. The stops of the engaging members which may be moved along the centering arms in the longitudinal direction by way of guide rods are engaged by the front face edges of the sheet to be stretched being inserted into the gripping head. The movement of the engaging members and hence of the sheet are transmitted to a measuring apparatus in a simple manner by appropriate means. In addition, the arrangement of the engaging members on the centering arms has the advantage that the engaging members may, on the one hand, detect the end of the sheet when the latter is inserted into the gripping heads and, on the other hand, be pulled out of the area of movement of the outer gripping jaws at right angles to the stretching axis with the aid of the centering arms before tightening the said outer gripping jaws.

According to a further feature of the invention a double-acting cylinder, the piston rod of which is connected to the engaging member, is disposed in the guide rod. This hydraulic or pneumatic cylinder with a small displacement force is operated in such a way that, when the sheet is inserted into the gripping head, it yields to the sheet with slight prestressing. In addition, by means of these cylinders and pistons, the stops of the engaging members may be moved clear of the edge of the sheet before the process of moving the centering arms apart.

As a further development of the invention a traction cable is provided as a transmission element for the movement of the engaging members, and, on the one hand, is wound up on a cable drum which is mounted on the centering arm and whose shaft is prestressed by a torsion spring and is connected to the shaft of a potentiometer acting as a measuring apparatus, and (the traction cable), on the other hand, is secured to a pin on the engaging member.

The use of a potentiometer has the advantage over adjustable limit switches that any position may be registered without adjusting the measuring device. Thus, on the one hand, a switching signal may be given by preselecting the depth of insertion on the control desk and, on the other hand, a check may be made before the insertion of the sheet to see whether the engaging members are in the required starting position. Compared with a transmission by means of a rack and pinion, the use of a cable has the advantage of a smaller space requirement, particularly in the case of stretching very short sheets, where the gripping heads must be as close to one another as possible.

According to a further idea of the invention the engaging member or members are supported in the extended position with their front faces against the rear surfaces of the aperture of the gripping heads. The abutment against the rear surface occurs before the piston reaches the bottom of the cylinder. In this way any possible damage to the cylinder-piston unit is avoided.

BRIEF DESCRIPTION OF THE DRAWINGS

The invention is described in greater detail below with reference to the accompanying drawings, wherein

FIG. 7 is a horizontal cross-sectional view through the center of a gripping head during the centering of the sheet by centering arms in accordance with the invention, FIG. 8 is a view similar to FIG. 7 showing positions of the parts during the insertion of the sheet, FIG. 9 is a view similar to FIG. 8 showing the parts after the sheet has been gripped by the central gripping jaws of the gripping head, and FIG. 10 is a view similar to FIG. 9 showing the parts after moving the centering arms apart and gripping by the outer gripping jaws in the position shown in FIG. 3.

DETAILED DESCRIPTION

Figure 1:
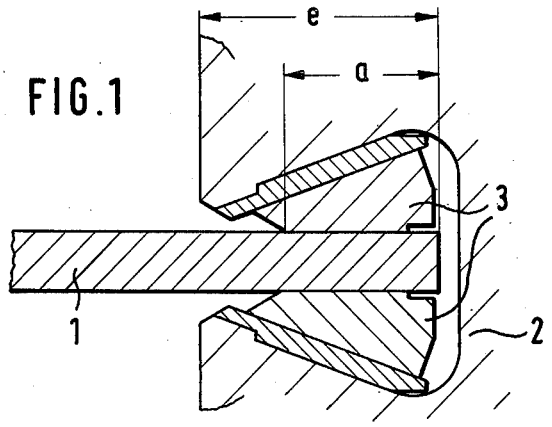
FIG. 1 is a vertical cross-sectional view in the stretching direction through the gripping head of a sheet stretcher with a thick sheet gripped therein in accordance with the invention.
Figure 2:
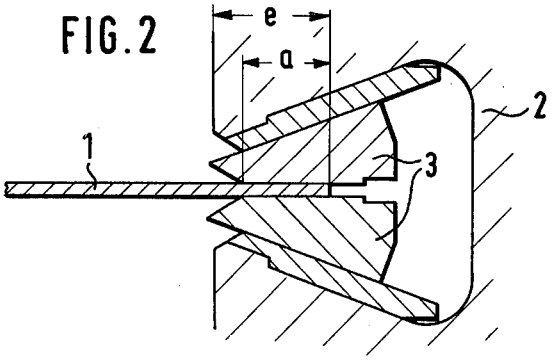
FIG. 2 is a view similar to FIG. 1, but showing a thin sheet gripped in the gripping head.

In FIGS. 1 and 2 the different insertion depths e and minimum gripping lengths a are shown in a section through a gripping head 2 in the case of a thick sheet 1 (FIG. 1) and a thin sheet 1 (FIG. 2). The respective sheet 1 is gripped by gripping jaws 3 disposed in the aperture of the gripping head 2. The minimum gripping length a is the distance between the end of the sheet 1 and the front edge of the gripping jaws 3.

Figure 3:
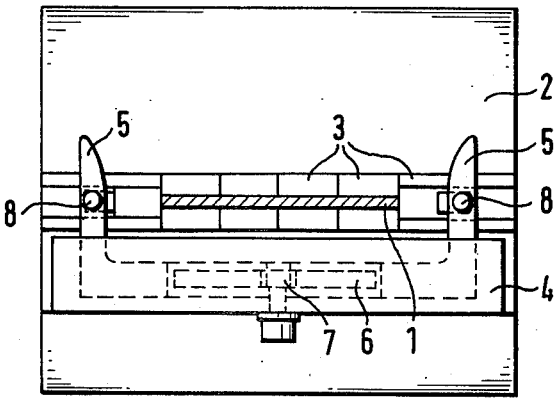
FIG. 3 is a cross-sectional view transverse to the stretching axis through the sheet showing in elevation a gripping head with a centering device with a sheet gripped therein and centering arms moved apart (same relative position of parts as shown in FIG. 10)

FIG. 3 is a view towards a gripping head 2 of a sheet stretcher and a centering device 4 with a sheet 1 gripped between the gripping jaws 3. The centering device 4 comprises centering arms 5 which are provided with racks 6 with which a driven pinion 7 engages (see also FIG. 7). A synchronous movement of the centering arms 5 towards the stretching axis for the purpose of centering an inserted sheet 1 is ensured by the centering arms 5 being positively connected via the pinion 7 and the racks 6. A complete centering device 4 is attached to each of the two gripping heads 2 of the sheet stretcher not illustrated in greater detail. Measuring and switching devices 8 for determining the depth of insertion of the sheet 1 and the command for discontinuing the displacement of the sheet 1 are provided on the centering arms 5.

Figure 4:
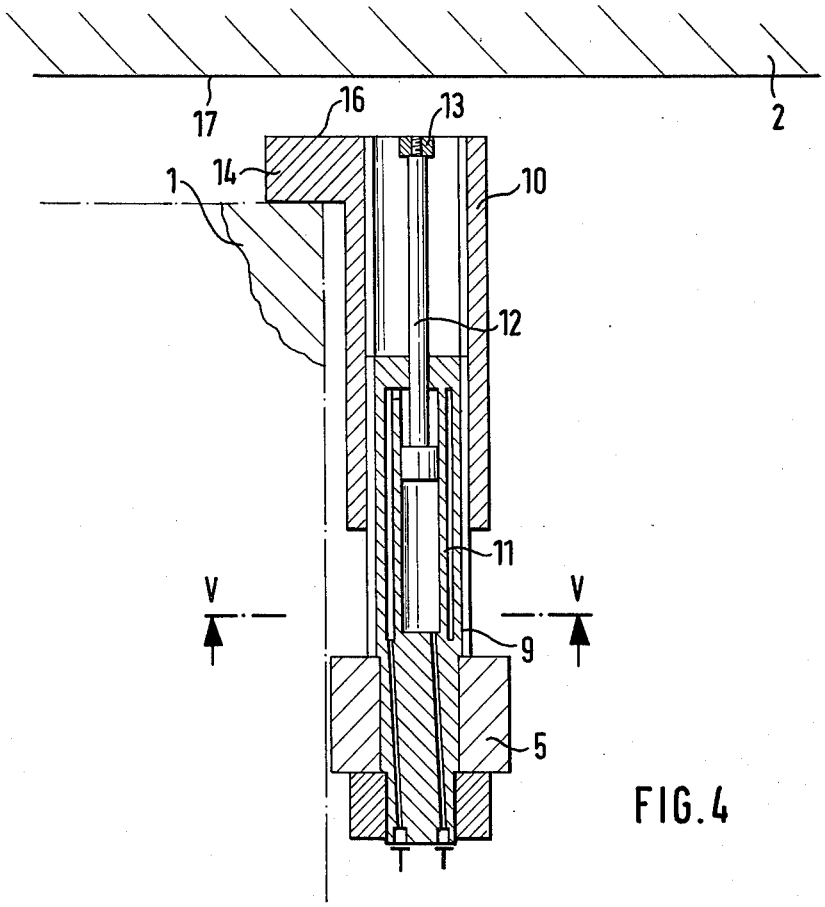
FIG. 4 is a horizontal cross-sectional view on an enlarged scale through a sheet with an engaging member bearing thereon.
Figure 5:
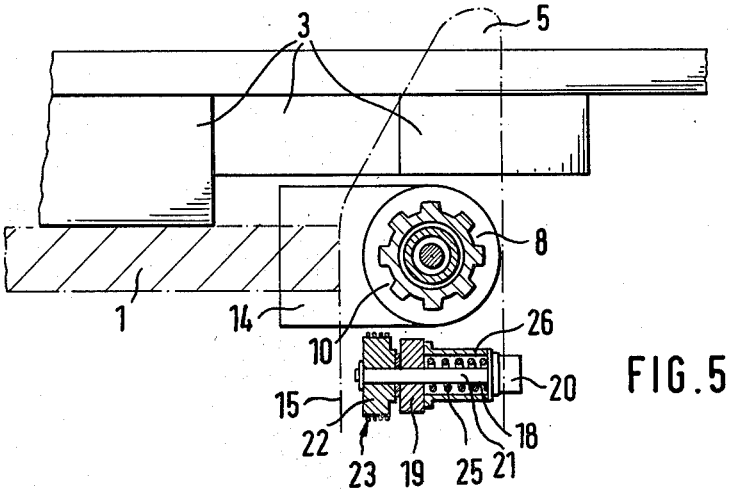
FIG. 5 is a cross-sectional view taken along line V—V of FIG. 4 through a guide rod of the engaging member with a measuring device.
Figure 6:
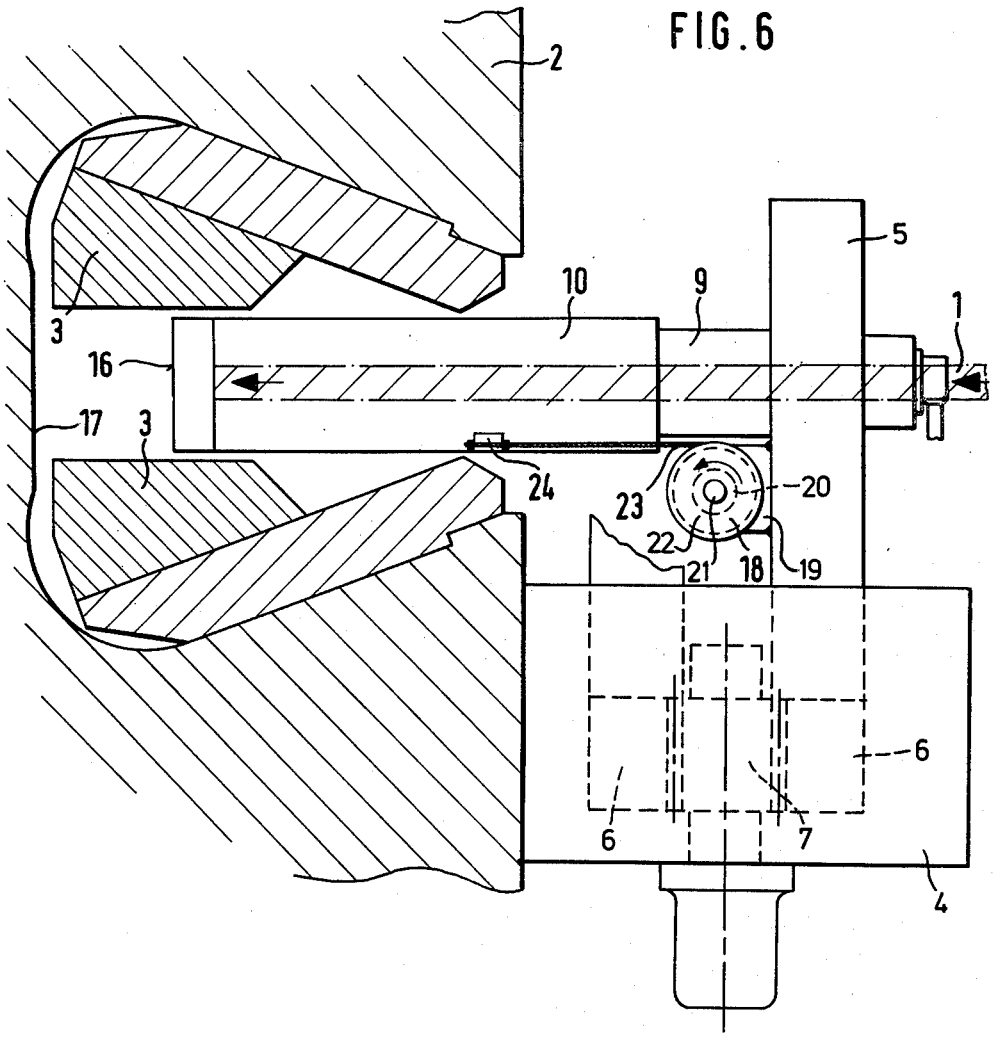
FIG. 6 is a vertical cross-sectional view through the gripping aperture of the gripping head with a side elevational view of the engaging member and measuring device.

A measuring and switching device 8 is illustrated in section and on an enlarged scale in FIG. 4. It comprises a guide rod 9 secured to the centering arms 5, an engaging member 10 sliding on the said guide rod 9, a double-acting working cylinder 11 moving the engaging member 10 and a distance-measuring apparatus 18 secured to the centering arm 5 (FIGS. 5 and 6). The working cylinder 11 is disposed inside the guide rod 9. The end of a piston rod 12 of the piston sliding in the working cylinder 11 is secured to a cross member 13 which in turn is connected to the engaging member 10 (FIG. 4).

The engaging member 10 (FIG. 4) is provided with a hook-shaped stop 14. This stop 14 projects beyond the centering edge 15 (FIG. 5) of the centering arm 5 extending towards the center of the sheet stretcher and detects the front edge of the inserted sheet 1. The front face 16 of the completely extended engaging member 10 may bear against the rear inside surface 17 of the gripping head 2, so that the piston rod 12 of the working cylinder 11 is protected against the exertion of excessive force by the sheet 1 (FIG. 4).

FIG. 5 is a section through the measuring and switching device 8 along the line V—V of FIG. 4, namely through the guide rod 9 and the working cylinder 11. The guide rod 9 is formed as a spline shaft in the area for guiding the engaging member 10. The distance-measuring apparatus 18 likewise illustrated in section is mounted on a plate 19 welded to the centering arm 5 (FIGS. 5 and 6). The distance-measuring apparatus 18 essentially comprises a potentiometer 20, the shaft 21 of which is connected to a cable drum 22. A cable 23, the free end of which is secured to a pin 24 on the engaging member 10, is wound up on the said cable drum 22 (FIG. 6). In order to ensure that the cable 23 is wound securely on to the cable drum 22, the cable 23 is held under slight tension by a spring 25 which is located in a housing 26.

The gripping procedure of the sheet 1 is illustrated in successive phases in FIGS. 7 to 10, namely in a horizontal section in each case through the center of the gripping head 2 showing the centering device 4, where the centering arms 5 are shown in section.

Figure 7:
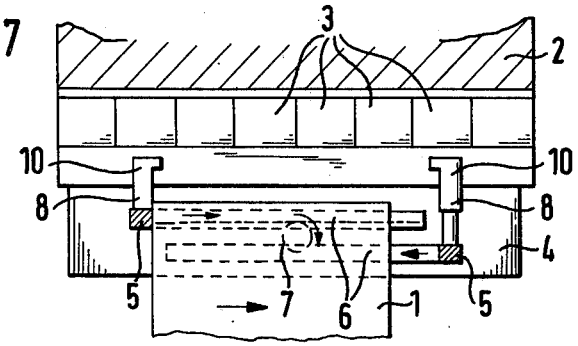
FIGS. 7 to 10 show an operating sequence from the insertion of the sheet to be stretched into the gripping head, the centering of the sheet on to the stretching axis and the gripping of the sheet. In particular.
Figure 8:
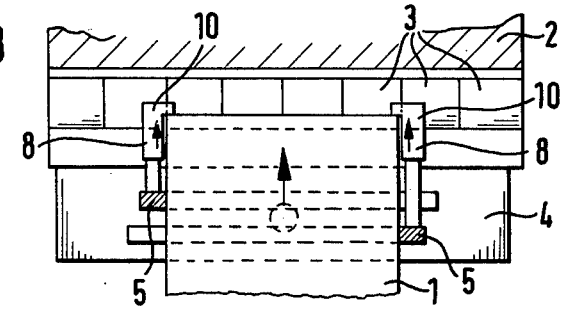

FIG. 7 shows the centering procedure of a sheet 1 to be stretched which has been inserted into the gripping head 2 and is lying eccentrically. FIG. 8 shows the sheet 1 contacting the stops 14 (FIG. 4) of the engaging members 10 and moving them in the insertion direction during insertion. During this procedure the cable 23 secured to the engaging member 10 is unwound from the cable drum 22 disposed on the centering arm 5. The potentiometer 20 is also adjusted with the same revolution of the cable drum 22.

Figure 9:
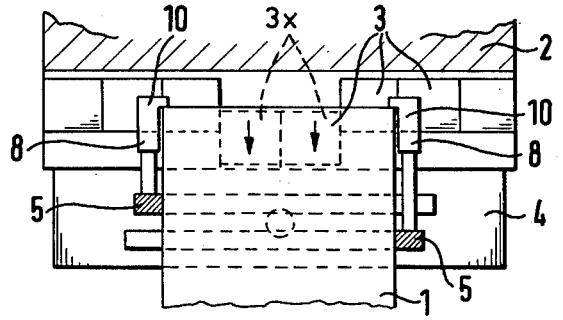

FIG. 9 shows the situation after the insertion of the sheet 1. The insertion is discontinued when the preselected insertion position is reached after delivery of a signal by the potentiometer 20, whereupon the sheet 1 is gripped initially by the inner gripping jaws 3*x*, which are arranged between the centering arms 5 and are clear of the stops 14. The number of inner gripping jaws 3*x* is determined by the width of the sheet.

Figure 10:
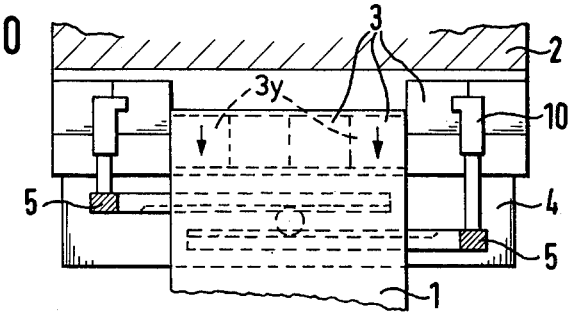

Then, in accordance with FIG. 10, the stops 14 and the engaging members 10 are moved clear of the contact point on the front edge of the sheet 1 by means of the working cylinder 11. With the aid of the pinion 7 and the racks 6 of the centering device 4 connected to the guide rods 9 by arms 5, the engaging members 10 are moved laterally out of the gripping area of the remaining gripping jaws 3*y* taking part in the gripping procedure. The gripping procedure is concluded after the latter gripping jaws 3*y* have also been tightened.

We claim:

1. A gripping head of a sheet stretcher comprising:

a gripping head having a gripping opening therein;

at least one pair of openable and closable gripping jaws operably mounted in said opening to grippingly engage the end portion of a sheet to be stretched;

a sheet centering device mounted in cooperative relationship with said gripping head comprising, two centering arms movable in substantially opposite directions with respect to each other and transversely with respect to the opening and closing direction of said jaws between centering and retracted positions, means to operate said centering arms to automatically position the end position of the sheet substantially centrally with respect to said jaws; and means operatively mounted on at least one of said centering arms for determining the depth of insertion of the end portion of the sheet in said gripping opening.

2. A gripping head as claimed in claim 1 wherein said means for determining the depth of insertion comprise a guide rod mounted on said centering arm, an engaging member movably mounted on said guide rod for movement into and return from the space between said jaws, a stop member on said engaging member for engaging the front inserted end of the sheet, a distance measuring device mounted on said centering arm, and means operatively connecting said measuring device to said engaging member so that said measuring device will measure the distance moved by said engaging member.

3. A gripping head as claimed in claim 2 wherein said guide rod comprises an internal double-acting cylinder and cooperating piston movable toward and from said jaws, and a piston rod connected to said engaging member.

4. A gripping head as claimed in claim 3 wherein said measuring device comprises a potentiometer and said connecting means comprises a cable attached at one end to said potentiometer and at the other end to said engaging member.

5. A gripping head as claimed in claim 4 wherein said potentiometer comprises a rotatable potentiometer mounted on a shaft rotatably mounted on said centering arm, a cable drum mounted on said shaft, said cable being wound on said drum, and a torsion spring operatively connected between said arm and said shaft to resiliently urge said drum, shaft and potentiometer toward a retracted position.

6. A gripping head as claimed in claim 5 wherein said engaging member in its most extended position engages at its outer end face against the inner bottom surface of said gripping opening.

7. A gripping head as claimed in claim 2 wherein said gripping jaws comprise a plurality of pairs of jaws arranged over at least a part of the width of said gripping opening to provide inner jaws and outer jaws, said jaws being operable in cooperation with said centering arms so that when said sheet is in the inserted position, said inner jaws between said centering arms are closable while said arms are in the centering position, and said outer jaws are closable when said arms are in the retracted position.

8. A gripping head as claimed in claim 5 wherein said centering arms comprise spaced parallel elongated bar members extending parallel to the gripping surfaces of said jaws, gear racks on the surfaces of said bar members facing each other, a drive pinion operatively engaging said gear rods to reciprocate said bar members, and extensions on the outer ends of said bar members extending perpendicular thereto and substantially parallel to the direction of gripping of said jaws, and a said means for determining the depth of insertion of the sheet is mounted on each extension, said guide rods extending perpendicular to said extensions toward said jaws.

* * * * *